United States Patent [19]

Casasent

[11] Patent Number: 4,660,167

[45] Date of Patent: Apr. 21, 1987

[54] SPACE-MULTIPLEXED TIME-INTEGRATING ACOUSTO-OPTIC CORRELATORS

[75] Inventor: David Casasent, Pittsburgh, Pa.

[73] Assignee: Teledyne Industries, Inc., Northridge, Calif.

[21] Appl. No.: 712,194

[22] Filed: Mar. 15, 1985

[51] Int. Cl.[4] ..... G06G 9/00

[52] U.S. Cl. ..... 364/822; 364/821; 350/358

[58] Field of Search ..... 364/819–822, 364/807, 829–830, 837, 713, 728, 604; 350/358, 96.12–96.16, 162.12, 162.13, 162.14

[56] References Cited

U.S. PATENT DOCUMENTS

| | | | |
|---|---|---|---|
| 3,802,762 | 4/1974 | Kiemle | 364/822 X |
| 4,124,280 | 11/1978 | Berg et al. | 350/358 |
| 4,225,938 | 9/1980 | Turpin | 364/822 |
| 4,440,472 | 4/1984 | Cohen | 350/162.12 |
| 4,468,084 | 8/1984 | Hutcheson et al. | 350/96.11 |
| 4,468,093 | 8/1984 | Brown | 350/162.12 |
| 4,519,046 | 5/1985 | Cole | 364/822 |
| 4,531,195 | 7/1985 | Lee | 364/822 |
| 4,558,925 | 12/1985 | Casseday et al. | 350/358 |
| 4,566,760 | 1/1986 | Abramovitz et al. | 350/358 |

*Primary Examiner*—Gary V. Harkcom

*Attorney, Agent, or Firm*—Blakely, Sokoloff, Taylor & Zafman

[57] ABSTRACT

Space multiplexed time integrating acousto-optic correlators can achieve multiple signal correlations with an infinite range delay search. In some embodiments, two stage synchronization may be achieved an N channel demodulation may be achieved with automatic synchronization realignment.

12 Claims, 4 Drawing Figures

SPACE-MULTIPLEXED TIME-INTEGRATING ACOUSTO-OPTIC CORRELATORS

BACKGROUND OF THE INVENTION

1. Field of the Invention

The present invention relates to the field of acousto-optic devices and acousto-optic signal processing.

2. Prior Art

Acousto-Optic (acousto-optic) devices are well-known and widely used light modulators, being generally described in the literature, including *Proc. IEEE, Special Issue on Acousto-Optics,* Vol. 69, January 1981, and *Acousto-Optic Signal Processing: Theory and Implementation,* Ed. N. J. Berg and J. N. Lee, Marcel Dekker, Inc., New York, 1983.

In accordance with this technology an input electrical signal s(t) to such a device is converted to a sound field in the acousto-optic cell crystal by an input transducer. This wave then travels the length of the crystal, with an absorber at the far end of the device causing the wave to terminate at the end of the device with no reflections. The input electrical signal is presented on a carrier as $s_1(t)=s(t)\cos\omega_c t$ or $s_2(t)=[B+s(t)]\cos\omega_c t$, where s(t) is a zero-mean signal and B is a bias. When illuminated with light, the cell diffracts the input light at angles proportional to $n\omega_c$. These waves are referred to as diffracted orders, and the wave $\propto\pm\omega_c$ as the first order wave.

As the sound field travels the length of the cell, the sound field s(x,t) in the cell varies in space x and time t. Depending on the acousto-optic cell and the input signal $s_1(t)$ or $s_2(t)$, the amplitude or intensity of the first-order wave can be made proportional to s(t) or B+s(t) respectively. For amplitude modulation, the input electrical signal is s(t) cos $\omega_c t$ and the amplitude of the first-order wave is $$A_1(t,x)=e^{j\omega t}jA_{in}Ks(t-x/v)e^{j\omega_c(t-x/v)} \quad (1)$$

i.e. the amplitude is proportional to s(t−x/v)

$$A_1(t,x)\propto s(t-x/v), \quad (2)$$

where K is a constant, $A_{in}$ is the amplitude of the input light wave and $\omega_L$ is its frequency, and v is the velocity of sound in the acousto-optic material. For intensity modulation, the input electrical signal is [B+s(t)] cos $\omega_c t$ and the intensity of first-order wave is $$I(t,x)=KI_{in}[B+s(t-x/v)], \quad (3)$$

where K is a constant and $I_{in}=|A_{in}|^2$. Thus, except for a constant bias, the intensity is proportional to s(t−x/v), $$I(t,x)\propto s(t-x/v). \quad (4)$$

By a single change of variables, (2) and (4) can be written as s(x−vt). The representations in (2) and (4) are more appropriate for a time-integrating acousto-optic processor as shall subsequently be seen.

The classic time-integrating acousto-optic correlator of FIG. 1 is well-known and described in detail elsewhere, including the two references previously referred to and in R. A. Sprague and C. L. Koliopoulos, "Time Integrating Acousto-Optic Correlator", *Applied Optics,* Vol. 15, pp. 89–92, January 1976; and P. Kellman, "Time Integrating Optical Processors", in *Optical Processing Systems,* W. Rhodes, ed. (Proc. SPIE, Vol. 185, 1979), pp. 130, 1979. Ignoring Bragg or Raman-Nath mode, amplitude or intensity modulation, any bias and $\omega_c$ carrier, and single-sideband filtering (described in the foregoing references), the operation of the system can easily be described. The system of FIG. 1 consists of a point modulator fed with a signal $s_b(t)$. Its output is expanded (by lens $L_1$) to uniformly illuminate an acousto-optic cell at $P_2$. The light distribution incident on $P_2$ is thus $s_b(t)$, varying in time and being uniform in space. With $s_a(t)$ fed to the acousto-optic cell, its transmittance is $s_a(t-\tau)$, where $\tau=x/v$ as in (2) or (4). The light leaving $P_2$ is now $s_b(t)s_a(t-\tau)$. Lenses $L_2$ image $P_2$ onto $P_3$ (and SSB filters the result). Since any bias and the $\omega_c$ carrier have been ignored, the pattern leaving $P_2$ and the pattern incident on $P_3$ are the same. The detector at $P_3$ time integrates the incident pattern and the $P_3$ output obtained is $$R(\tau)=\int s_b(t)s_a(t-\tau)dt=s_b * s_a, \quad (5)$$

i.e. the correlation (symbol * ) of $s_a$ and $s_b$ is displayed as a function of space ($\tau\propto x$) at $P_3$.

The time integrating correlator is advantageous when $T_S>T_A$ and $TBWP_S$22 $TBWP_A$, where $T_s$ is the signal duration, $T_A$ is the acousto-optic cell aperture time, $TBWB_S$ is the signal time-bandwidth product and $TBWP_A$ is the acousto-optic cell time-bandwidth product. The processor of FIG. 1 can thus provide the correlation output for a very long signal, with the integration time $T_I$ of the detector determining the $T_S=T_I$ value used. If detector dynamic range is exceeded, the contents of the detector are dumped and stored (after some $T_I'<T_S$) and a new integration is begun. By noncoherently adding the $R(\tau)$ outputs for separate $\tau_I'$, the full $T_I=T_S$ integration is achieved (at a loss of about 3 dB in processing gain due to the noncoherent summation). The time integrating correlator can however only search a limited time delay between signals $T_D(-T_A/2<T_D<T_{A/2})$ set by $T_A$ of the acousto-optic cell, i.e., $T_D<T_A$.

The purpose of the present invention is to provide a system which can achieve multiple signal correlations and an infinite $T_D$ range delay search.

BRIEF SUMMARY OF THE INVENTION

Space multiplexed time integrating acousto-optic correlators are disclosed. These time integrating processors can achieve multiple signal correlations with an infinite range delay search. In some embodiments, two stage synchronization may be achieved and N channel demodulation may be achieved with automatic sync realignment. Various embodiments are disclosed.

DETAILED DESCRIPTION OF THE INVENTION

Figure 1:
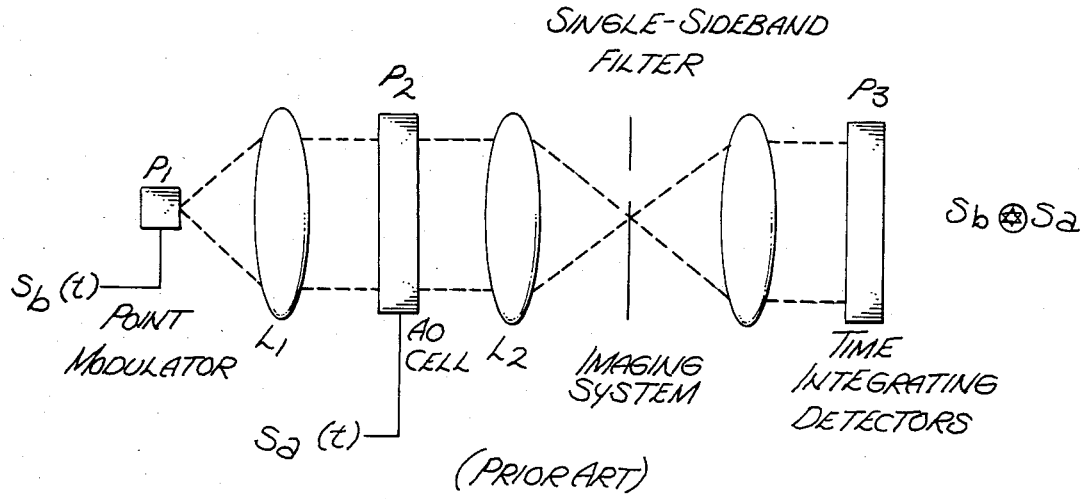
FIG. 1 is a block dagram of a typical prior art time integrating acousto-optic correlator.
Figure 2:
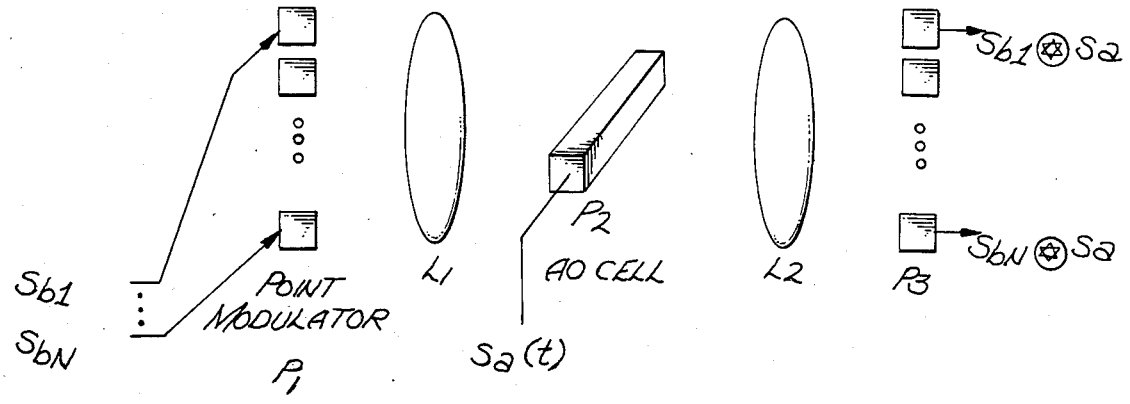
FIG. 2 is a block diagram illustrating an embodiment of the present invention which can achieve multiple signal correlations and an infinite range delay search.

The present invention time integrating processor can achieve multiple-signal correlations and an infinite ($T_D=\infty$) range delay search. This new architecture is shown in FIG. 2. In this case, N inputs at $P_1$ and N detectors at $P_3$ are used. Lens system $L_1$ collimates each $P_1$ source horizontally (to uniformly illuminate the acousto-optic cell at $P_2$) and focuses all $P_1$ point modulators vertically to illuminate the acoustic column in the acoutso-optic cell at $P_2$. $L_1$ is thus two cylindrical lenses. Denoting the N inputs at $P_1$ by $s_{bn}$, the N waves leaving $P_2$ are $s_{bn}(t)s_a(t-\tau)$. Lens system $L_2$ collimates vertically (i.e., $L_1$ and $L_2$ image vertically) and integrates (Fourier transforms) horizontally. Thus, $L_2$ consists of two cylindrical lenses. The horizontal lens compresses the light leaving $P_2$ into the desired horizontal size at $P_3$. The vertical $L_2$ lens together with the vertical $L_1$ lens image $P_1$ onto $P_3$ with the desired vertical scale to match the input point modulators and the output detectors.

The system of FIG. 2 thus yields N spatially-separated correlation outputs, with the horizontal size of each controllable. Considered herein are two uses of this system with different $s_{bn}$ input signals and slightly different detector arrangements. Then considered is a general unified system for both uses.

Figure 4:
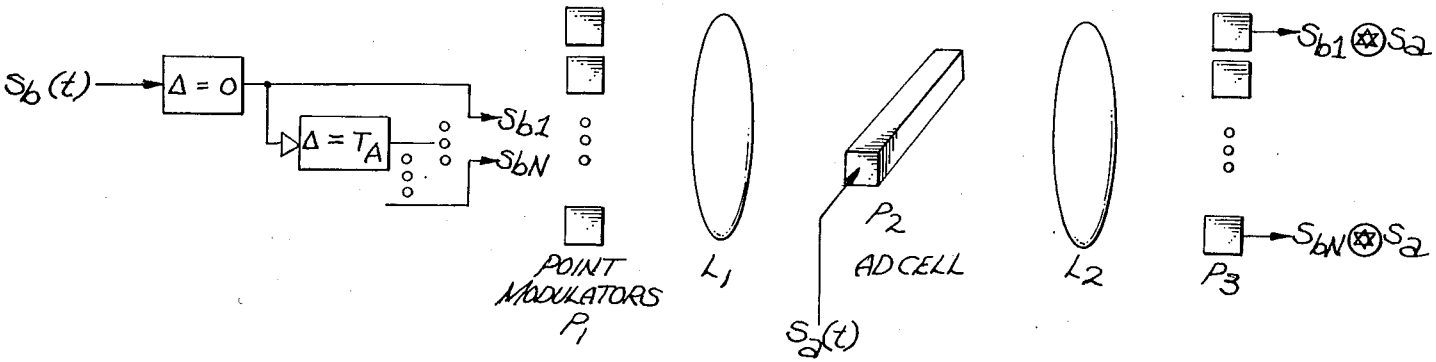
FIG. 4 is a block diagram of an embodiment of the invention for a combined sync and demodulation application.

Consider the case when the N inputs to $P_1$ are delayed versions $s_{b1}(t)=s_{b(t)}$, $s_{b2}(t)=s_b(t-T_A)$, $s_{b3}(t)=s_b(t-2T_A)$, etc. of the same reference signals $s_b(t)$ as in FIG. 4. The N correlation outputs are the correlations of $s_a$ with different delayed versions ($T_A$, $2T_A$, $3T_A$, etc.) of $s_b$. If we select $$NT_A=T_S=T_I \tag{6}$$

and integrate each output for $T_I=T_S$, then the full set of N correlations covers a delay $$T_D=NT_A=T_S=I_I. \tag{7}$$

Each $T_I$, these N correlation outputs are analyzed and the full processing gain over $T_I$ is achieved for a delay $T_D=NT_A$. The N references at $P_1$ are cyclically repeated each $T_I=T_S$. Thus, in the next $T_I=T_S$, the next $T_D=NT_A$ delays are checked. Thus, this system achieves an infinite $T_D$ delay for signals with $T_I=T_S=NT_A$.

At each of the N detector locations in $P_3$, a linear horizontal detector array with $M=TBWP_A$ detector elements can be placed. By reading out these N linear detector arrays, fine sync within $T_A/TBWP_A$ can be achieved (after a delay equal to the readout time of each one dimensional detector array).

Figure 3:
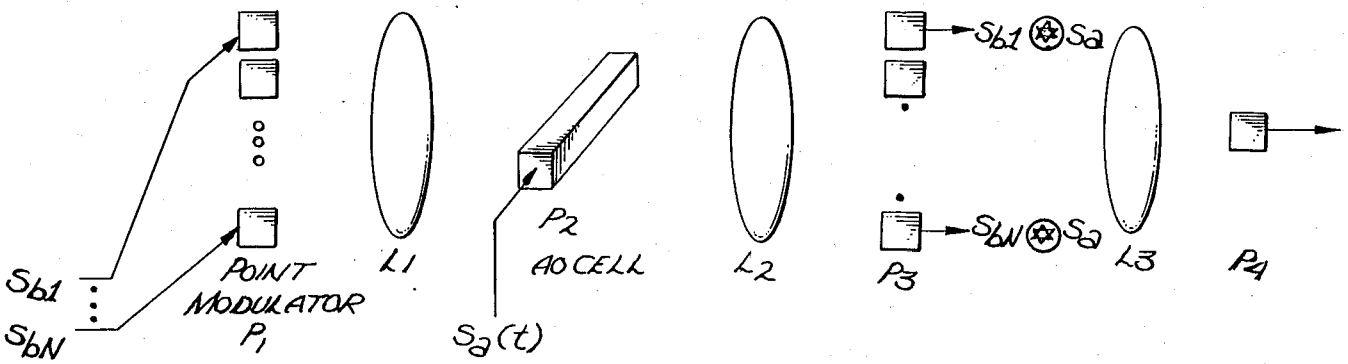
FIG. 3 is a block diagram of an alternate embodiment of the system of FIG. 2 to provide a fine sync capability.

A preferable arrangement in many cases would employ only one detector in each of the N correlation locations in $P_3$. Each detector would be large enough to fully cover each of the correlation planes (the horizontal component of lens $L_2$ can be chosen to achieve the required horizontal imaging compatible with the detector geometry). In this case, only N detectors need be read out. This can be achieved in parallel each $T_I=T_S$. The detector with a peak above threshold denotes the delay between $s_a(t)$ and $s_b(t)$ and hence the sync information. However, this is coarse sync within $T_D=T_A$ only. By summing each full correlaion pattern onto one detector, some loss in $P_D$ (probability of detection) and $P_E$ (probability of error) results. A statistical analysis for the specific sync code used can determine the optimum N, $T_A$ and M (number of detectors per correlation plane) values to use for each case. Of course N and $T_A$ must still be chosen to satisfy (6) and/or (7). With M detectors in each of the N output correlation locations, coarse sync within $T_A/M$ results. A typical value might be $M=3$ as discussed later. After coarse sync within $T_A$ or $T_A/M$ (as described above), $s_a(t)$ can be delayed by $T_I=T_S$ and $s_b(t)$ synchronized within $T_A$ and fed to one (e.g. the central) of the modulators at $P_1$. On one output channel (e.g. the center of $P_3$), a fully populated detector with $M=TBWP_A$ elements can be placed. The location of the correlation peak now provides fine sync within $T_A/TBWP_A$. In practice, a third lens $L_3$ can be used and the fully populated fine detector with M elements can be placed in a new $P_4$ plane behind this $L_3$, as shown in FIG. 3.

To summarize the steps in the two step coarse/fine synchronization, the N delayed $S_b(t)$ signals are applied to $P_1$, with the N (or NM) detector outputs providing coarse sync within $T_A$ (or $T_A/M$). Thereafter $S_a(t)$ can be delayed by $T_I=T_S$ and the one S(t) $P_1$ input spaced within $T_A$ (or $T_A/M$) applied to the light source for the fully populated channel. Now the fully populated outputs on this one channel provide fine sync within $T_A/TBWP_A$.

For a demodulation application, the reference signals $s_{bn}(t)$ are in sync with $s_a(t)$. To demodulate N possible codes, the N references $s_{bn}$ in FIG. 2 are simply the N codes. The correlation output with a peak above threshold defines which of the N codes is present each $T_S=T_I$. For demodulation $T_S=T_I$ is generally much less than for synchronization. Electronic control of the detector integration time is easily achieved. With fully populated detector arrays at $P_3$, only the central element of each need be interrogated (since the reference and received signals are in sync). To allow for drift in sync, $M=3$ detectors in each of the N correlation outputs can be used. If detection occurs on other than the central detector, the system sync is readjusted.

$M=3$ detectors covering each of the N full correlation planes appears to provide acceptable detection performance. This simplifies the output detector system, the output plane electronic support and its analysis required. It also allows for a combined system as discussed below.

The synchronization and demodulation systems described above can be combined in various ways. The N input signals to $P_1$ are electronically controlled to be N delayed versions of the synchronization waveform (FIG. 4) or N codes (FIGS. 2 and 3), depending upon the operating mode (synchronization or demodulation). N fully populated detector arrays with $TBWP_A$ detectors in each are possible. Preferable arrangements utilize M detectors per correlation output ($M=3$ typically). With N output detector arrays with M elements each and one output detector array with $TBWP_A/M$ detectors, two-stage synchronization (coarse/fine) is possible, N channel demodulation is achieved (FIG. 2), and sync realignment (with $M=3$ detectors per channel) is achieved. Obviously, while the present invention has been disclosed and described with respect to certain preferred embodiments, it will be understood that various changes in the form and detail may be made therein without departing from the spirit and scope thereof.

I claim:

1. A method of correlating a signal $S_a(t)$ with another signal $S_b(t)$ having a signal duration $T_s$ comprising the steps of (a) providing an acousto-optical cell having an input transducer for creating a sound field in said cell responsive to the electric signal $S_a(t)$ applied thereto, the acousto-optic cell having a predetermined aperture time $T_A$;

(b) substantially uniformly illuminating the cell with light from each of a plurality (N) of light sources substantially equal in number to the signal duration $T_S$ divided by the cell aperture time $T_A$, or $T_S/T_A$, each emitting light having an intensity or amplitude responsive to the signal applied thereto, the first of the light sources having a signal applied thereto responsive to the signal $S_b(t)$, each successive light source in the plurality of light sources having a signal applied thereto corresponding to the signal applied to the next preceeding light source delayed in time by a time delay substantially equal to $T_A$, (c) detecting the light passing through the cell from each of the light sources by a plurality (N) of light sensitive devices equal in number to the plurality (N) of light sources, each of the light sensitive devices being responsive to light from a respective one of said light sources, and (d) integrating each light sensitive device output for a time $T_I$ substantially equal to the signal duration $T_S$ to provide a plurality of correlation outputs covering a time delay range of $T_D=NT_A$.

2. The method of claim 1 wherein steps (b), (c) and (d) are repeated each signal duration whereby correlation outputs covering substantially infinite time delays may be obtained.

3. The method of claim 1 for synchronizing the signals $S_a(t)$ and $S_b(t)$ comprising the further step of determining the light sensitive detector having the correlation output for which $S_a(t)$ and $S_b(t)$ best correlate, and delaying one of the signals $S_a(t)$ and $S_b(t)$ by an amount dependent on which light sensitive detector output indicated the best correlation, whereafter the correlation output indicating the best correlation will be a predetermined correlation output.

4. The method of claim 3 wherein at least the light sensitive device providing the predetermined correlation output comprises a plurality of light sensors, wherein step (d) comprises the step of integrating each light sensor output for a time $T_I$ substantially equal to the signal duration $T_S$ to provide a correlation output for each sensor, and further including, after the step of claim 3, the additional step of determining the light sensor having the correlation output for which $S_a(t)$ and $S_b(t)$ best correlate, and adjusting the timing of one of the signals $S_a(t)$ and $S_b(t)$ with respect to the other by an amount dependent on which correlation output indicated the best correlation, whereafter the light sensor having the correlation output on the predetermined light sensor indicating the best correlation determines fine synchronization.

5. A method of demodulating a signal $S_a(t)$ by a plurality of reference signals $S_{bn}(t)$ having a signal duration $T_S$ comprising the steps of (a) providing an acousto-optical cell having an input transducer for creating a sound field in said cell responsive to the electric signal $S_a(t)$ applied thereto, the acousto-optic cell having a predetermined aperture time $T_A$;

(b) substantially uniformly illuminating the cell with light from each of a plurality (N) of light sources substantially equal in number to the signal duration $T_S$ divided by the cell aperture time $T_A$, or $T_S/T_A$, each emitting light having an intensity or amplitude responsive to the signal applied thereto, the first of the light sources having a signal applied thereto responsive to the signal $S_b(t)$, each successive light source in the plurality of light sources having a signal applied thereto corresponding to the respective signal $S_{bn}(t)$;

(c) detecting the light passing through the cell from each of the light sources by a plurality (N) of light sensitive devices equal in number to the plurality (N) of light sources, each of the light sensitive devices being responsive to light from a respective one of said light sources, and (d) integrating each light sensitive device output for a time $T_I$ substantially equal to the signal duration $T_S$ to provide a plurality of demodulation outputs covering a time delay range of $T_D=NT_A$.

6. A space multiplexed, time integrating correlator comprising a plurality (N) of light sources, each for emitting light having an intensity or amplitude responsive to a first electric signal applied thereto;

an acousto-optic cell extending in a first direction and having an input transducer for creating a sound field in said cell responsive to a second electric signal applied thereto;

a first lens means between said plurality of light sources and said acousto-optic cell for substantially uniformly illuminating said acousto-optic cell with light from each of said light sources;

a plurality (N) of time integrating light detection means equal in number to said light sources, each for providing a signal responsive to the time integral of the light incident thereto; and a second lens means between said acousto-optic cell and said plurality of light detection means to illuminate each of said light detection means with light originating from a respective one of said light sources.

7. The space multiplexed, time integrating correlator of claim 6 wherein each of said light sources is a substantially point light source.

8. The space multiplexed, time integrating correlator of claim 6 further including means for coupling a first signal to a first of said plurality of light sources, and for coupling to each successive said light source, said first signal delayed in time by a predetermined time delay with respect to the signal as coupled to the preceeding light source, whereby the signal coupled to $n_{th}$ light source is delayed by an amount equal to the time delay with respect to the signal coupled to the (n−1) light source, and wherein said first signal as applied to said first of said plurality of light sources is repeated each time period equal to said predetermined time delay.

9. The space multiplexed, time integrating correlator of claim 8 wherein the time delay is substantially equal to $T_A$, the acousto-optical cell aperture time, wherein the integration time $T_I$ of said light detection means is substantially equal to N times the acousto-optical cell aperture time, and wherein the output of each of said light detection means is analyzed each $T_I$ to determine the correlation between said first and second electrical signals occurring during the respective integration time.

10. The space multiplexed, time integrating correlator of claim 6 wherein said detection means comprise a plurality (M) of light detectors at each vertical location.

11. The space multiplexed, time integrating correlator of claim 10 wherein M is substantially equal to the time bandwidth product of the Acousto-Optic cell.

12. The space multiplexed, time integrating correlator of claim 6 wherein one of said detection means comprises a plurality equal to the acousto-optic cell time-bandwidth product $TBWP_A$ of detectors and the remainder of said detection means each comprise only a few detectors.

* * * * *